US007711285B2

(12) United States Patent
Makiura et al.

(10) Patent No.: US 7,711,285 B2
(45) Date of Patent: May 4, 2010

(54) CLEANING DEVICE FOR AN IMAGE FORMING APPARATUS

(75) Inventors: Takashi Makiura, Nara (JP); Takashi Kubo, Kyoto (JP); Koichi Moriyama, Ikoma (JP); Shunichi Hayashiyama, Nara (JP); Mitsuru Ogura, Nara (JP); Tetsuya Yamaguchi, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 455 days.

(21) Appl. No.: 10/595,249

(22) PCT Filed: Oct. 1, 2004

(86) PCT No.: PCT/JP2004/014511

§ 371 (c)(1),
(2), (4) Date: Mar. 30, 2006

(87) PCT Pub. No.: WO2005/033805

PCT Pub. Date: Apr. 14, 2005

(65) Prior Publication Data

US 2007/0071487 A1 Mar. 29, 2007

(30) Foreign Application Priority Data

Oct. 2, 2003 (JP) ..... 2003-344704
Oct. 2, 2003 (JP) ..... 2003-344705

(51) Int. Cl.
*G03G 15/08* (2006.01)

(52) U.S. Cl. ..... 399/102; 399/123; 399/343; 399/350; 399/351; 399/398; 399/399

(58) Field of Classification Search ..... 399/102, 399/123, 343, 350, 351, 398, 399
See application file for complete search history.

(56) References Cited

U.S. PATENT DOCUMENTS 4,483,606 A * 11/1984 Kuwako et al. ..... 399/105

(Continued)

FOREIGN PATENT DOCUMENTS

JP 58-010462 1/1983

(Continued)

OTHER PUBLICATIONS

Electronic English Translation of JP2000330439.*

(Continued)

*Primary Examiner*—David M Gray
*Assistant Examiner*—Ryan D Walsh
(74) *Attorney, Agent, or Firm*—Renner, Otto, Boisselle & Sklar, LLP

(57) ABSTRACT

A cleaning device is provided with a cleaning unit (35) disposed downstream from a position at which a toner image is transferred to a paper. The cleaning unit (35) is provided with a cleaning blade (35*c*) for scraping off residual toner attached to an image bearing member and a toner catching sheet (35*e*) for preventing the residual toner or paper dust which have been scraped off from falling outside the cleaning unit. The free length in the toner catching sheet (35*e*) between affixed positions of a first end portion which is affixed to the cleaning unit (35) and a second end portion which abuts an outer circumferential portion of the image bearing member is determined by an amount of paper dust buildup on the outer circumferential portion of the image bearing member.

6 Claims, 10 Drawing Sheets

U.S. PATENT DOCUMENTS

| | | | | |
|---|---|---|---|---|
| 4,730,205 | A * | 3/1988 | Ogiri et al. | 399/350 |
| 5,021,830 | A * | 6/1991 | Koiso | 399/103 |
| 5,450,185 | A * | 9/1995 | Kuribayashi et al. | 399/350 |
| 5,455,665 | A * | 10/1995 | Baba et al. | 399/358 |
| 6,658,223 | B2 * | 12/2003 | Nishimura et al. | 399/102 |
| 6,975,823 | B2 * | 12/2005 | Onishi et al. | 399/350 |
| 2002/0131799 | A1 * | 9/2002 | Kubo | 399/350 |
| 2004/0141771 | A1 * | 7/2004 | Oshiba et al. | 399/350 |
| 2005/0185997 | A1 * | 8/2005 | Kubo et al. | 399/350 |
| 2005/0214045 | A1 * | 9/2005 | Ohta et al. | 399/350 |

FOREIGN PATENT DOCUMENTS

| | | |
|---|---|---|
| JP | 02-108089 | 4/1990 |
| JP | 03-245173 | 10/1991 |
| JP | 07-092874 | 4/1995 |
| JP | 08-083031 | 3/1996 |
| JP | 09-090837 | 4/1997 |
| JP | 10-039708 | 2/1998 |
| JP | 11-106073 | 4/1999 |
| JP | 11-316515 | 11/1999 |
| JP | 2000-081819 | 3/2000 |
| JP | 2000-330439 | 11/2000 |
| JP | 2004-198979 | 7/2004 |

OTHER PUBLICATIONS

International Search Report for corresponding Application No. PCT/JP2004/014511 mailed Nov. 9, 2004.

* cited by examiner (A)

(B)

CLEANING DEVICE FOR AN IMAGE FORMING APPARATUS

TECHNICAL FIELD

The present invention relates to cleaning devices applied to image forming apparatuses for forming images on paper by transferring toner images formed on the outer circumferential portions of the image holding bodies, for eliminating residual toner and paper dust which attach to outer circumferential portions of image holding bodies.

BACKGROUND ART

Conventional methods for transporting paper (including recording media such as OHP, etc.) to an image forming portion when forming images in an image forming apparatus include a first paper feeding method for feeding paper to the image forming portion from a paper feeding cassette disposed in the interior of the device body and a second paper feeding method for feeding paper to the image forming portion from a manual paper feeding tray disposed in the exterior of the device body.

During image formation, paper that is stored in the above-mentioned paper feeding cassette and manual paper feeding tray is selectively fed one sheet at a time, and images are formed as the paper is transported to the image forming portion via a paper transporting route. Here, the paper is separated one sheet at a time by a separating member, as the paper is fed one sheet at a time. Talc material (bleaching agents, extending agents, and so on; it seems that the main component is $SiO_2$), which is paper dust contained in the paper, therefore separate from the paper, for example, through friction between the paper and the separating member. This paper dust attaches to and accumulates on transporting rollers, which are disposed along a paper transporting route, as well as an outer circumferential portion of a photosensitive body (an image bearing member) which is provided in the image forming portion, as being charged due to friction with the transporting rollers and so on, thereby inviting a drop in image quality.

For example, as shown in FIG. 6, the paper dust P, which attaches to the outer circumferential portion of a photosensitive body 31, is eliminated by a cleaning unit 35 together with residual toner which remains on the outer circumferential portion of the photosensitive body 31 after transfer to the paper of a toner image formed on the outer circumferential portion of the photosensitive body 31. The cleaning unit 35 is disposed on the outer circumferential portion of the photosensitive body 31 further downstream in a rotating direction of the photosensitive body 31 indicated by the arrow Y in FIG. 6 than the position at which the toner image, which is formed on the outer circumferential portion of the photosensitive body 31, is transferred to the paper, and is provided, in the main unit body in which is formed an open portion 35*a*, with a cleaning blade 35*c* and a toner catching sheet 35*e* whose rigidity is set sufficiently high that an apical portion does not separate from an image bearing member 31 due to vibration.

The open portion 35*a* collects into the cleaning unit 35 residual toner and so on which has been scraped off. The cleaning blade 35*c* partially touches the outer circumferential portion of the photosensitive body 31 and scrapes off the residual toner and the paper dust P attached to the outer circumferential portion of the photosensitive body 31. The toner catching sheet 35*e* prevents the scraped-off residual toner and so on from falling onto the paper transporting route and elsewhere, without being collected from the open portion 35*a*.

At this time, toner with high fluidity is collected from the open portion 35*a* after separating from members such as the cleaning blade 35*c* which touches the outer circumferential portion of the photosensitive body 31, but the paper dust P has low fluidity and therefore separates with difficulty and accumulates on members such as the cleaning blade 35*c* which touches the outer circumferential portion of the photosensitive body 31.

The paper dust P separates from members on which it has accumulated after a certain amount has accumulated, and is partially collected from the open portion 35*a*, but the majority reattaches to the outer circumferential portion of the photosensitive body 31 and mixes into the developer tank and so on disposed in the outer circumferential portion of the photosensitive body 31. When the paper dust P mixes into the developer tank, it interferes with proper charging of the toner due to differences in charge characteristics between toner and paper dust ($SiO_2$), thereby encouraging generation of uncharged toner, which creates a drop in image quality and blurred images. In particular, as shown in FIG. 6, the paper dust P which separates from the cleaning blade 35*c* readily accumulates on the toner catching sheet 35*e* after falling, the aperture area of the open portion 35*a* is narrowed by the accumulated paper dust P, and the ability to collect the residual toner and the paper dust P drops. Since the toner catching sheet 35*e* is located further upstream in a rotating direction of the photosensitive body 31 than the cleaning blade 35*c*, the paper dust P easily accumulates at portions in contact with the outer circumferential portion of the photosensitive body 31 and the vicinity thereof, so the paper dust P which has accumulated thereby separates and falls onto the paper transporting route or paper onto which the toner image has been transferred, causing a drop in image quality.

Accordingly, recent image forming apparatuses abut a cleaning roller, which has a larger coefficient of kinetic friction than the coefficient of kinetic friction of a feed roller and a surface of a separating member abutting the feed roller, against the outer circumferential portion of the feed roller and the surface of the separating member, thereby eliminating paper dust and so on which attaches to the outer circumferential portion of the feed roller and the surface of the separating member by the difference in the coefficients of kinetic friction. (See, for example, Patent document 1.) With the configuration of in Patent document 1, the paper dust and so on which attaches to the outer circumferential portion of the cleaning roller is eliminated by the cleaning blade which abuts the outer circumferential portion of the cleaning roller.

Furthermore, there are also examples of image forming apparatuses which eliminate paper dust attached to the outer circumferential portion of the photosensitive body by providing a capturing brush to a cleaning device, which collects residual toner disposed on the outer circumferential portion of the photosensitive body, such that it touches the outer circumferential portion of the photosensitive body, and applying a voltage to the capturing brush. (See, for example, Patent document 2.)

Patent document 1: JP H11-106073A

Patent document 2: JP 2000-81819A

DISCLOSURE OF INVENTION

Problems to be Solved by the Invention

However, with the configuration of Patent document 1, even if a cleaning portion is disposed with the paper dust not in a charged state, the eliminating effect is incomplete, and elimination of paper dust is insufficient. Furthermore, a cleaning roller must additionally be provided, increasing cost and enlarging the apparatus.

Moreover, while it is possible to capture paper dust in a charged state which is attached to the outer circumferential portion of the photosensitive body using the capturing brush with the configuration of Patent document 2, not only does application of a voltage to the capturing brush which touches the outer circumferential portion of the photosensitive body invite deterioration of the photosensitive body (because the voltage applied in order to eliminate the paper dust is close to the saturation charge potential of the photosensitive body), but problems are also caused in image formation on the next paper which is transported.

The present invention has an object of providing a cleaning device which efficiently eliminates paper dust attached to the outer circumferential portion of the photosensitive body without scratching the outer circumferential portion of the photosensitive body while eliminating residual toner.

Means for Solving Problem

The cleaning device according to the present invention comprises a cleaning unit which is provided with an open portion disposed opposite an outer circumferential portion of an image bearing member and is disposed downstream of a position for transferring to a paper a toner image which is formed on the image bearing member; a cleaning blade, for scraping off residual toner attached to the image bearing member, which is provided in the interior of the cleaning unit and wherein an apical portion abuts the outer circumferential portion of the image bearing member; and a toner catching sheet disposed upstream in a rotating direction of the image bearing member from the open portion of the cleaning unit, said toner catching sheet being provided in the interior of the cleaning unit and parallel in a lengthwise direction to an axial direction of the image bearing member; a first end portion of the toner catching sheet in a direction perpendicular to the lengthwise direction being affixed to the cleaning unit, a second end portion of the toner catching sheet opposed to the first end portion abutting the outer circumferential portion of the image bearing member, and the free length of the toner catching sheet from an affixed position of the first end portion until the position at which the second end portion abuts the outer circumferential portion of the image bearing member being determined in the lengthwise direction by an amount of paper dust buildup on the outer circumferential portion of the image bearing member.

With this configuration, the free length of the toner catching sheet which is provided in the cleaning unit is determined by the amount of paper dust buildup attached to the outer circumferential portion of the image bearing member which opposes the toner catching sheet in the lengthwise direction (the axial direction of the image bearing member). In other words, in the lengthwise direction of the toner catching sheet, the free length of the portion opposing a location where there is a large amount of paper dust buildup on the outer circumferential portion of the image bearing member differs from the free length of the portion opposing a location where there is a small amount of paper dust buildup on the outer circumferential portion of the image bearing member.

On the other hand, paper dust separates from paper when the paper is separated one sheet at a time by the separating member, when the stored paper is transported from the paper feeding cassette, etc., to a position where the toner image is transferred. The paper is therefore transported with the paper dust attached to portions which come in contact with the separating member. The paper dust is charged through friction with the transporting rollers and so on during transportation of the paper, and therefore attaches to the outer circumferential portion of the image bearing member during transfer of the toner image to the outer circumferential portion of the image bearing member. For this reason, the amount of paper dust which attaches to the outer circumferential portion of the image bearing member differs in the axial direction of the image bearing member, or in other words, in the lengthwise direction of the cleaning unit.

Since paper dust has low fluidity, the paper dust which is scraped off by the cleaning blade readily accumulates on the toner catching sheet. Moreover, the toner catching sheet touches the outer circumferential portion of the image bearing member, so the paper dust also accumulates at portions of the toner catching sheet which touch the outer circumferential portion of the image bearing member and the vicinity thereof. Therefore, the amount of paper dust which accumulates on the toner catching sheet in the lengthwise direction varies depending on the amount of paper dust buildup on the opposing outer circumferential portion of the image bearing member.

Here, the toner catching sheet vibrates through transmission of vibration from a drive of a transporting screw, etc., which is provided in the interior of the cleaning unit. The amplitude of the vibration grows with the length of the free length described above. Accordingly, the vibration is large at portions of the toner catching sheet where the free length described above is long, and paper dust is more easily eliminated which has built up on the outer circumferential portion of the image bearing member.

Accordingly, by making a first free length corresponding to a location at which there is a large amount of paper dust buildup on the outer circumferential portion of the image bearing member longer than a second free length corresponding to a location at which there is a small amount of paper dust buildup on the outer circumferential portion of the image bearing member on the toner catching sheet, the paper dust which has accumulated on portions opposite locations at where there is a large amount of paper dust buildup on the toner catching sheet can more easily be separated. The paper dust therefore does not clump by accumulating on the toner catching sheet, but rather separates and flows into the cleaning unit from the open portion which is located downstream in the rotating direction of the image bearing member from the toner catching sheet by riding the flow of wind created by rotation of the image bearing member.

In another embodiment of the present invention, in addition to the toner catching sheet, a paper peeling claw is also provided, being provided upstream of the cleaning unit and abuttable to the image bearing member, for peeling from the image bearing member the paper onto which the toner image is transferred when it abuts the image bearing member.

The paper peeling claw causes the toner catching sheet to vibrate by touching the toner catching sheet when abutting and separating.

At the same time as the paper peeling claw abuts or separates from the image bearing member, it touches the toner catching sheet, and the toner catching sheet thereby vibrates and the paper dust separates.

Effects of the Invention

The amplitude of the portions opposing locations where there is a large amount of paper dust buildup on the outer circumferential portion of the image bearing member of the toner catching sheet can be made larger than the amplitude of the portions opposing locations where there is a small amount of paper dust buildup on the outer circumferential portion of the image bearing member of the toner catching sheet. The paper dust can thereby more efficiently separate from the image bearing member.

Further, the toner catching sheet can be caused to vibrate by operation of the paper peeling claw which peels the paper from the outer circumferential portion of the image bearing member. There is no need to provide a special mechanism for causing this vibration separate from the paper peeling claw, making it possible to realize a compact and inexpensive device.

BEST MODE FOR CARRYING OUT THE INVENTION

Figure 1:
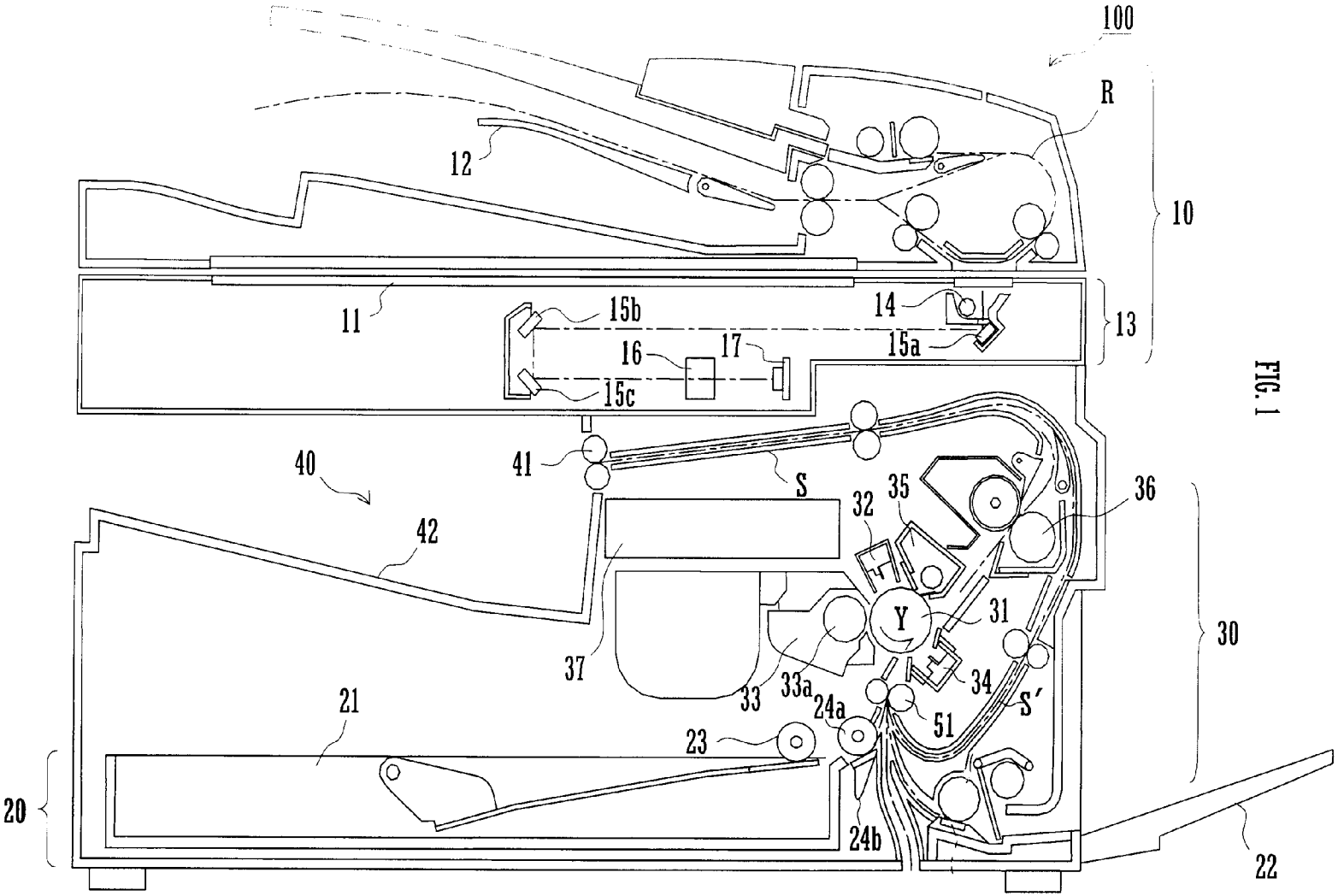
FIG. 1 is a cross-sectional view showing a general configuration of an image forming apparatus including a cleaning device according to an embodiment of the present invention.

FIG. 1 is a cross-sectional view showing a general configuration of an image forming apparatus in which a cleaning device according to an embodiment of the present invention is applied.

An image forming apparatus 100, which is the present invention, has a copier mode, a printer mode, and a fax mode as image forming modes for forming images on paper (including recording media such as OHP, etc.), each mode being selected by a user, and is capable of performing two-sided printing.

The image forming apparatus 100 is made up of a document reading portion 10, a paper feeding portion 20, an image forming portion 30, a paper ejecting portion 40, and an operating panel portion and controlling portion and so on which are not shown in the drawings. The document reading portion 10 is disposed in an upper portion of the main apparatus body, and is made up of a platen glass 11, a document placement tray 12, an optical scanning system 13, and so on. The optical scanning system 13 has a light source 14, reflecting mirrors 15*a* through 15*c*, an optical lens 16, and a CCD (charge coupled device) 17. The light source 14 irradiates light on documents placed on the platen glass 11 or documents transported from the document placement tray 12 along a document transporting route R. The plurality of reflecting mirrors 15*a* through 15*c* reflect reflected light from the document and direct it to the optical lens 16. The optical lens 16 focuses the reflected light directed by the reflecting mirrors 15*a* through 15*c* and directs it to the CCD 17. The CCD 17 performs photoelectric conversion on the focused reflected light.

The paper feeding portion 20 is disposed in a lower portion of the main apparatus body and is made up of a paper feeding cassette 21, a manual tray 22, a paper feeding roller 23, a separating member 24, and so on. The paper feeding tray 21 and the manual tray 22 hold paper to be fed to the paper transporting route S during image formation. The paper feeding roller 23 rotates and transports paper contained in the paper feeding tray 21 and so on to the separating member 24. The separating member 24 is made up of a feed roller 24*a*, a plate member 24*b*, and so on, and transports the paper, which has been transported by the paper feeding roller 23, to the paper transporting route S one sheet at a time when the paper is transported with a plurality of sheets overlapping. The feed roller 24*a* abuts a surface of the plate member 24*b*, which has a lower friction coefficient than the outer circumferential portion, and transports to the paper transporting route S only a single sheet of paper on the side of the feed roller 24*a* when the paper is transported from the paper feeding roller 23 stacked in a plurality of sheets. For example, in a case in which two sheets of paper are transported from the paper feeding roller 23, the paper on the side which touches the plate member 24*b* is stopped on the surface of the plate member 24*b* by the friction with the plate member 24*b*, so only the paper on the side which touches the outer circumferential portion of the feed roller 24*a* is transported to the paper transporting route S via friction with the feed roller 24*a* and the rotation of the feed roller 24*a*.

The image forming portion 30 is disposed on the side of the manual tray 22 below the document reading portion 10 and has a laser scanning unit ("LSU") 37, a photosensitive body 31 which is the image bearing member of the present invention, and a fixing device 36, and is configured with a charging device 32, a developing device 33, an image transferring device 34, and a cleaning unit 35 disposed around the photosensitive body 31 in this order along the direction of the arrow Y which is the rotating direction of the photosensitive body 31.

The paper ejecting portion 40 is disposed above the paper feeding tray 21 and is made up of a paper ejecting roller 41, a paper ejection tray 42, and so on. The paper ejecting roller 41 ejects paper, which has been transported along the paper transporting route S, to the paper ejection tray 42. Further, the paper ejecting roller 41 can rotate in reverse, so when image formation is performed on both sides of the paper, it chucks paper which has been transported along the paper feeding route S and on which image formation is complete on the front surface and then rotates in a direction opposite the rotating direction for ejecting the paper and transports the paper to a paper transporting route S'. The front and rear surfaces of the paper are thereby reversed, the rear surface is opposed to the photosensitive body 31, and a toner image is transferred to the rear surface. The paper ejection tray 42 stores paper which has been ejected from the paper ejecting roller 41 and on which image formation is complete. The separating member 24 according to the embodiment of the present invention is disposed opposing a central section of the transported paper in a direction perpendicular to a paper transporting direction. The controlling portion controls all operations of the image forming apparatus 100 described above.

When copying an image of a document onto the paper in copier mode, the document to be copied is placed on the platen glass 11 of the document reading portion 10 or the document placement tray 12, settings such as number of sheets to print and printing scale are entered by pressing input keys provided in the operating panel portion, and a copying operation is started by pressing a start key which is not shown in the drawings.

Once the start key is pressed, in the image forming apparatus 100, the paper feeding roller 23 rotates and the paper is fed to the paper transporting route S. The fed paper is transported to a registration roller 51 which is provided along the paper transporting route S.

An apical portion in the transporting direction of the paper which has been transported to the registration roller 51 is chucked by the registration roller 51 such that it is parallel with an axial direction of the registration roller 51, in order to position it to match the toner image which is formed on the outer circumferential portion of the photosensitive body 31 which is to be transferred to the paper.

Image data read by the document reading portion 10 is sent as print data to the LSU 37 after being subjected to image processes under the conditions entered using the input keys and so on. The LSU 37 forms an electrostatic latent image by irradiating the outer circumferential portion of the photosensitive body 31, which has been charged to a predetermined potential by the charging device 32, via a polygon mirror and various lenses which are not shown in the drawings, based on the image data. Thereafter, the toner which is attached to a surface of an MG roller 33*a* which is provided in the developing device 33 is attracted to the outer circumferential portion of the photosensitive body 31 by the potential difference with the outer circumferential portion of the photosensitive body 31, and the electrostatic latent image is visualized.

Thereafter the paper, which is chucked by the registration roller 51 and the toner image formed on the outer circumferential portion of the photosensitive body 31 are positioned by the registration roller 51 and the paper is transported between the photosensitive body 31 and the image transferring device 34. Next, the toner image on the outer circumferential portion of the photosensitive body 31 is transferred to the paper using an image transferring roller which is provided in the image transferring device 34 and which is not shown in the drawings. Heat and pressure are applied to the paper on which transfer of the toner image is complete as it passes the fixing device 36, the toner image thereby being fused and fixed, and the paper is ejected to the paper ejection tray 42 by the paper ejecting roller 41.

Residual toner, paper dust, and so on, which are attached to the outer circumferential portion of the photosensitive body 31 after transfer of the toner image to the paper are collected by the cleaning unit 35.

Figure 2:
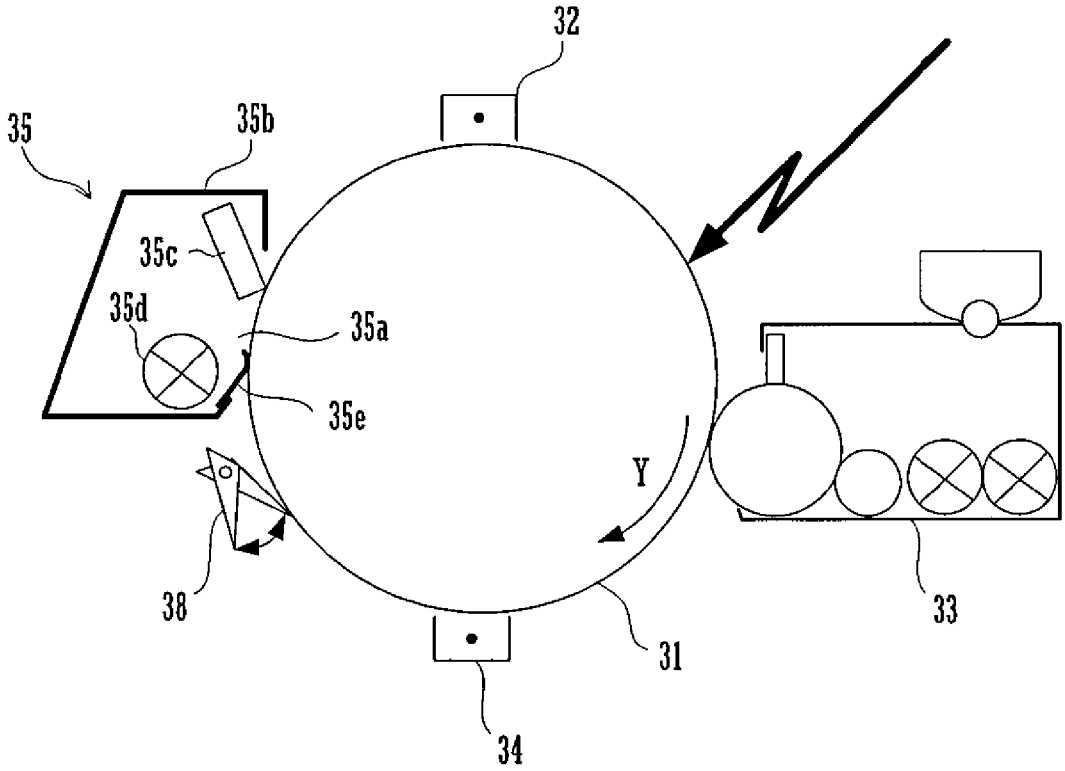
FIG. 2 is a cross-sectional view showing a partial enlargement of an image forming portion provided in the image forming apparatus in which the cleaning device is applied.

FIG. 2 is a cross-sectional view showing a partial enlargement of the image forming portion provided in the image forming apparatus in which a cleaning device according to an embodiment of the present invention is applied.

As shown in FIG. 2, the cleaning unit 35 is formed in a housing 35*b* such that the open portion 35*a* opposes the outer circumferential portion of the photosensitive body 31. The cleaning unit 35 is provided with a cleaning blade 35*c*, a transporting screw 35*d*, and a toner catching sheet 35*e*.

The cleaning blade 35*c* is affixed at one end portion in the direction perpendicular to with the lengthwise direction parallel to the axial direction of the photosensitive body 31 close to a top edge portion of the open portion 35*a*, while the other end portion, which opposes the above-mentioned end portion, abuts the outer circumferential portion of the photosensitive body 31 with a predetermined abutting force and scrapes off the residual toner and the paper dust on the outer circumferential portion of the photosensitive body 31. The transporting screw 35*d* is rotatably supported in the interior of the housing 35*b* and transports the residual toner and the paper dust which were scraped off the outer circumferential portion of the photosensitive body 31 from the interior of the housing 35*b* into an external collected toner storing box which is not shown in the drawings. The toner catching sheet 35*e* is affixed at one end portion in the direction perpendicular to the lengthwise direction parallel to the axial direction of the photosensitive body 31 close to a bottom edge portion of the open portion 35*a* and is formed of a resin film with a polarity opposite to that of the charge characteristics of the toner. The toner catching sheet 35*e* touches at the other end portion, which is opposite the affixed end portion, the outer circumferential portion of the photosensitive body 31. The toner catching sheet 35*e* prevents the residual toner and the paper dust which are scraped off the outer circumferential portion of the photosensitive body 31 from falling or leaking to the exterior.

The paper peeling claw 38 is disposed between the image transferring device 34 on the outer circumferential portion of the photosensitive body 31 and the cleaning unit 35 and peels from the photosensitive body 31 the paper onto which has been transferred the toner image at a section where the image transferring device 34 and the photosensitive body 31 oppose to each other.

Here, the toner catching sheet 35*e* has been formed of a resin film with charge characteristics of a polarity opposite that of the toner because the residual toner and the paper dust attached to the outer circumferential portion of the photosensitive body more easily attaches to the toner catching sheet and is more easily eliminated from the outer circumferential portion of the photosensitive body because the residual toner and the paper dust which are electrically attached to the outer circumferential portion of the photosensitive body can be attracted to the toner catching sheet by the charge characteristics. This is because using a resin film prevents scratching the outer circumferential portion of the photosensitive body. Note that the thickness of the toner catching sheet 35*e* is preferably between 0.05 mm and 0.01 mm. If the thickness is greater, the outer circumferential portion of the photosensitive body 31 is more easily scratched, and if the thickness is less, the form of the toner catching sheet 35*e* becomes difficult to maintain.

Figure 3:
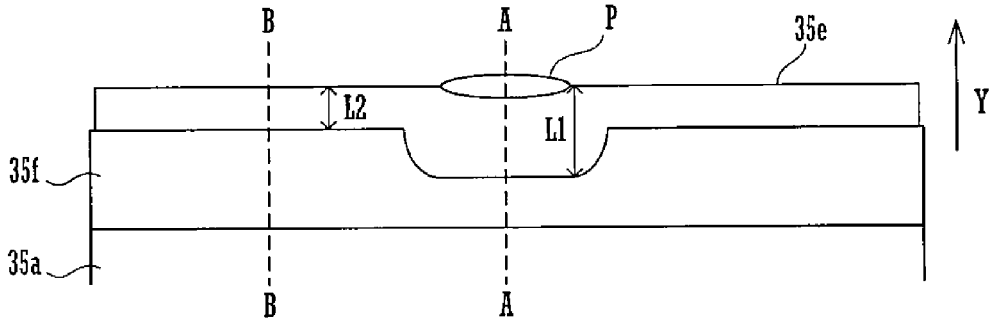
FIG. 3 is a cross-sectional view showing a partial enlargement of the image forming portion provided in the image forming apparatus in which the cleaning device is applied.

FIG. 3 is a view showing a partial enlargement of the exterior of the cleaning device according to the embodiment of the present invention. As shown in FIG. 3, the toner catching sheet 35*e* is affixed at a first end portion in the direction perpendicular to the lengthwise direction to the housing 35*b* by a sheet attaching member 35*f*. The sheet attaching member 35*f* is cut out at a central section in the lengthwise direction on the side of the toner catching sheet 35*e*.

Figure 4:
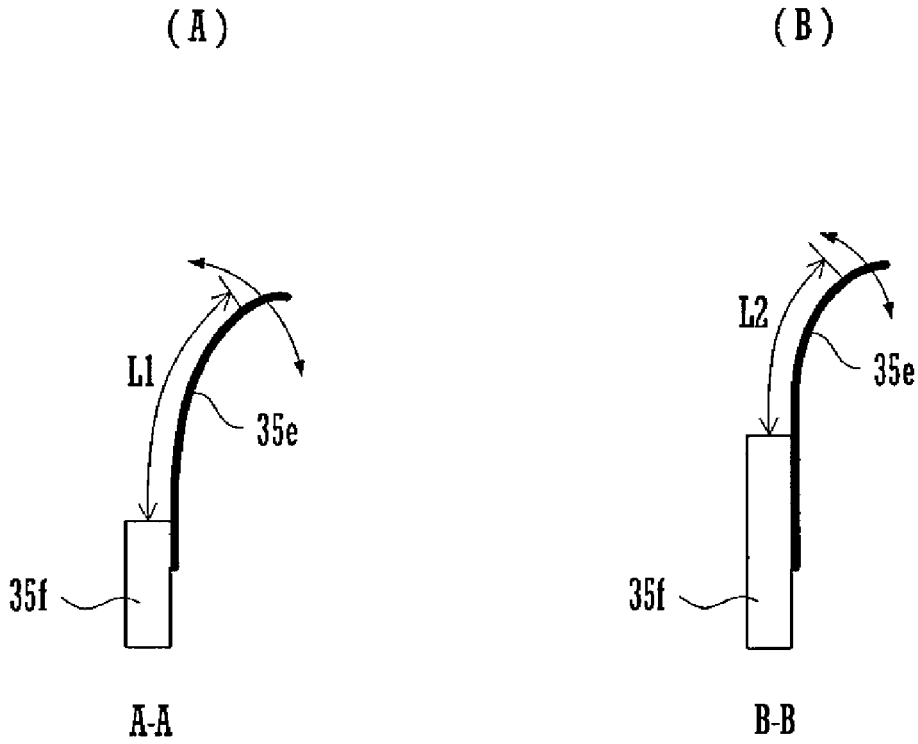
FIG. 4 is a lateral cross-sectional view and a planar view showing the exterior of a paper separating member in a paper feeding portion of the image forming apparatus.

Accordingly, as shown in FIG. 4(A) and FIG. 4(B), the affixed positions on the side of the first end portion in the direction perpendicular to the lengthwise direction of the toner catching sheet 35*e* differ at the central section in the lengthwise direction and in other sections.

Therefore, a free length L1 shown in FIG. 4(A) from the affixed position in the central section in the lengthwise direction of the toner catching sheet 35*e* to the position at which the second end portion touches the outer circumferential portion of the photosensitive body 31 is longer than a free length L2 shown in FIG. 4(B) from the above-mentioned affixed position outside the central section in the lengthwise direction of the toner catching sheet 35*e* to the position at which the second end portion touches the outer circumferential portion of the photosensitive body 31. As shown by the arrows in FIG. 4(A) and FIG. 4(B), the cleaning unit 35 vibrates due to driving by the transporting screw 35*d*, etc. Accordingly, the amplitude at the central section in the lengthwise direction of the toner catching sheet 35*e*, which has the free length L1 longer than the free length L2, is larger than other sections than the central section in the lengthwise direction of the toner catching sheet 35*e*. As a result, in the central section in the lengthwise direction of the toner catching sheet 35*e*, the second end portion easily separates from and abuts the outer circumferential portion of the photosensitive body 31 during vibration.

Here, the majority of the paper dust is generated through friction and so on between the paper and the separating member 24 when the paper, which is transported from the paper feeding tray 21, etc., during image formation, is separated one sheet at a time by the separating member 24. In this embodiment of the present invention, the separating member 24 touches the paper in the central section of the paper in a sub scanning direction, and the paper dust is generated from the central section of the paper in a sub scanning direction.

The paper dust is charged through friction with the transporting rollers and so on, which are not shown in the drawings, during transportation of the paper, and therefore attaches to the outer circumferential portion of the photosensitive body 31 during transfer of the toner image on the outer circumferential portion of the photosensitive body 31.

Accordingly, locations where there is a large amount of paper dust buildup on the outer circumferential portion of the photosensitive body 31 are locations opposite the central section of the paper in the sub scanning direction, so the amount of paper dust which attaches to the outer circumferential portion of the photosensitive body 31 differs in the axial direction of the photosensitive body 31.

Figure 5:
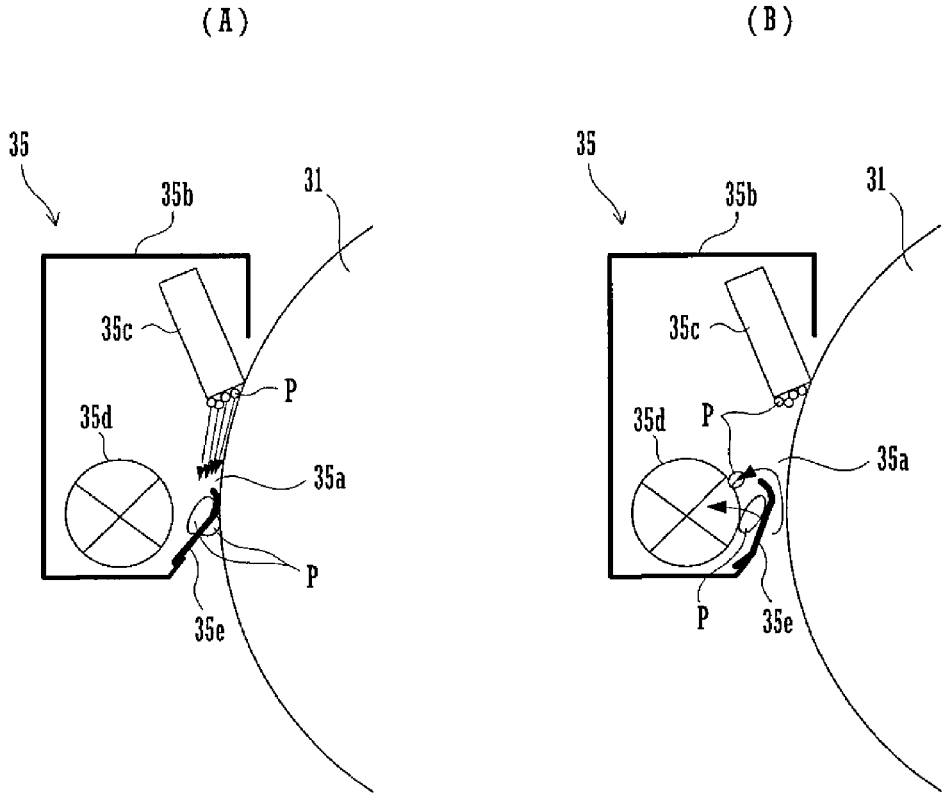
FIG. 5 is a cross-sectional view showing a partial enlargement of the image forming portion including the cleaning device according to an embodiment of the present invention.
Figure 6:
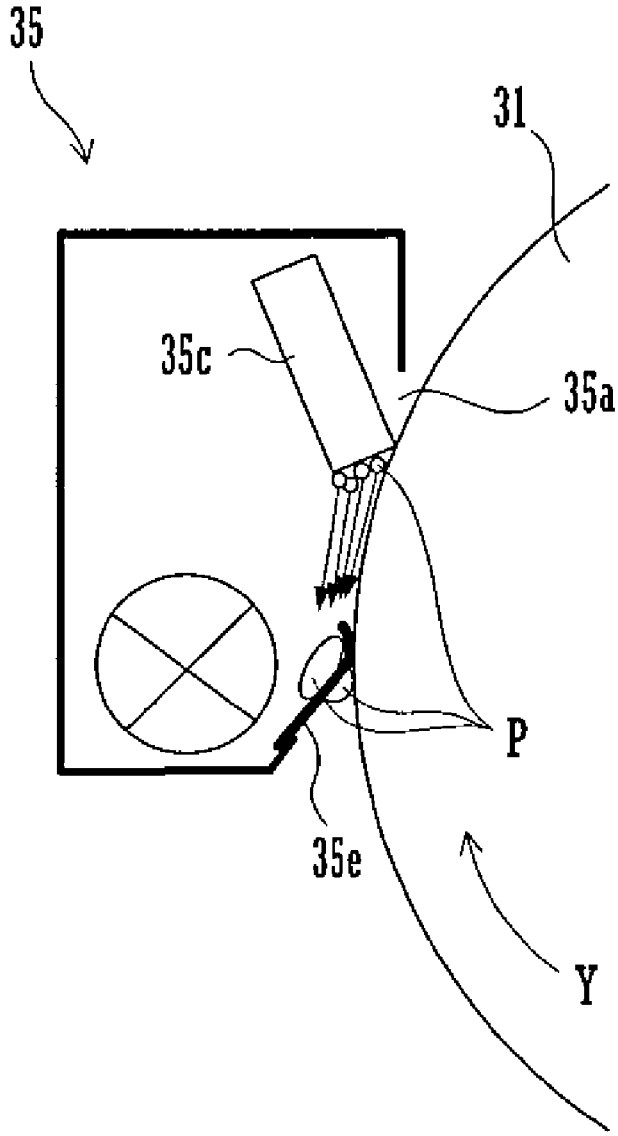
FIG. 6 is a cross-sectional view showing a partial enlargement of the image forming portion including the cleaning device to which is provided a highly rigid toner catching sheet.

On the other hand, paper dust has low fluidity, so, as shown in FIG. 5(A), the paper dust P which is scraped off by the cleaning blade 35*c* easily accumulates on the toner catching sheet 35*e*. Moreover, the toner catching sheet 35*e* touches the outer circumferential portion of the photosensitive body 31, so the paper dust also easily accumulates at portions of the toner catching sheet 35*e* which touch the outer circumferential portion of the photosensitive body 31 and the vicinity thereof. Therefore, the amount of paper dust P which accumulates on the toner catching sheet 35*e* in the lengthwise direction varies depending on the amount of paper dust buildup on the opposing outer circumferential portion of the photosensitive body 31.

With the above configuration, by making the amplitude of the vibration greater by making the free length L1 in the central section in the lengthwise direction of the toner catching sheet 35*e* that opposes locations where there is a large amount of paper dust buildup on the outer circumferential portion of the opposing photosensitive body 31 longer than the free length L2, the paper dust can be easily separated from the toner catching sheet 35*e* and collected from the open portion 35*a* by vibration, as shown in FIG. 5(B).

Here, the paper dust can be collected from the open portion 35*a*, which is located further downstream in the direction of the arrow Y from the location at which is disposed the toner catching sheet 35*e* because wind is generated in the direction of the arrow Y by rotation in the direction of the arrow Y of the photosensitive body 31. In other words, the paper dust P is separated from the toner catching sheet 35*e* without clumping by the vibration, and flows into the open portion 35*a* by riding the flow of this wind. Accordingly, the paper dust can be efficiently collected at sections on the toner catching sheet 35*e* opposing the paper dust buildup location, where paper dust accumulates easily.

Further, since the free lengths L1 and L2 of the toner catching sheet 35*e* are configured corresponding to the central section of the paper in the sub scanning direction which is where the paper touches the separating member 24 and where the paper dust P is generated, the free length L1 at the section on the toner catching sheet 35*e* which opposes more specific locations where there is a large amount of paper dust buildup on the outer circumferential portion of the photosensitive body 31 can be made longer, thereby making it possible to collect the paper dust P more efficiently in sections where the paper dust P accumulates easily in the toner catching sheet 35*e*.

Moreover, by configuring the free lengths L1 and L2 using the sheet attaching member 35*f*, the shape of the other end portion of the toner catching sheet 35*e* on the side where it touches the outer circumferential portion of the photosensitive body 31 is not limited for configuring the free lengths L1 and t2, making it possible to make the other end appropriately touch the outer circumferential portion of the photosensitive body 31 by forming the above other end portion parallel to the lengthwise direction of the paper, and thereby making it possible to receive the paper dust P and the residual toner which are scraped off by the cleaning blade 35*c* with the toner catching sheet 35*e*.

Note also that in the embodiment of the present invention, the location of paper dust buildup on the outer circumferential portion of the photosensitive body 31 is the central section in the axial direction of the photosensitive body 31, but this is not a limitation, and sections opposing locations where the paper dust from the paper is generated by the separating member 24 may be made the locations of the paper dust buildup.

Figure 7:
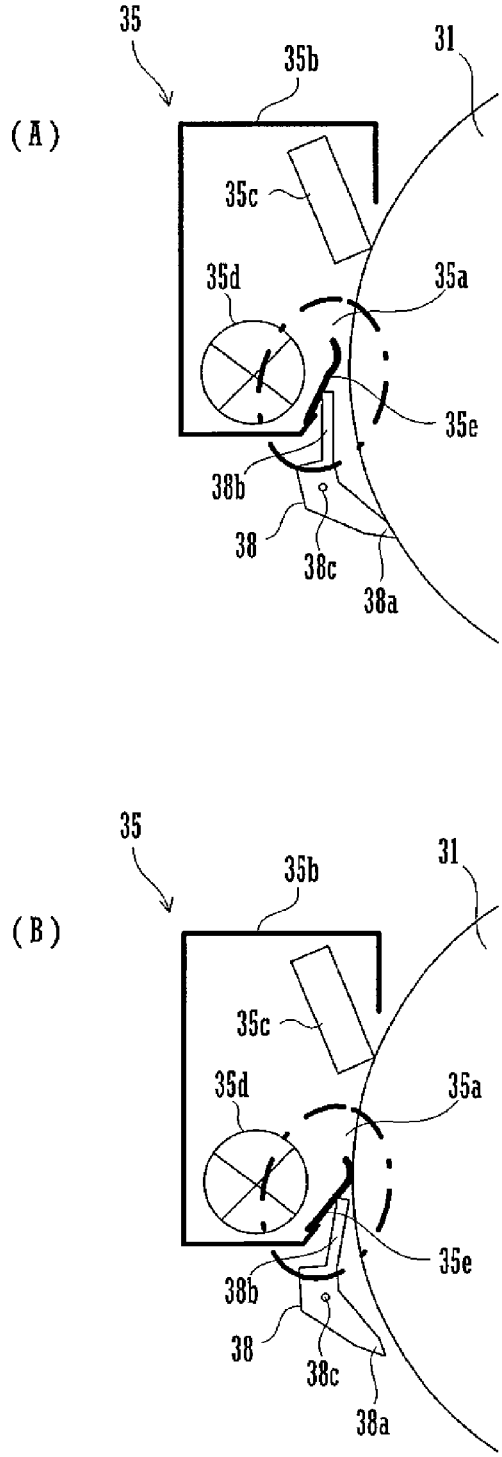
FIG. 7 is a cross-sectional view showing a partial enlargement of the image forming portion provided in the image forming apparatus in which a cleaning device according to another embodiment of the present invention is applied.

FIG. 7 is a cross-sectional view showing a partial enlargement of the image forming portion provided in the image forming apparatus in which a cleaning device according to another embodiment of the present invention is applied. The cleaning device according to the present embodiment is configured with the cleaning unit 35 and the paper peeling claw 38. The configuration of the cleaning unit 35 is the same as that shown in FIG. 2.

In FIG. 7, the paper peeling claw 38 is disposed between the image transferring device 34 on the outer circumferential portion of the image bearing member 31 and the cleaning unit 35, and performs a separating and abutting operation with respect to the outer circumferential portion of the image bearing member 31 upstream of the cleaning unit 35 in the rotating direction of the image bearing member 31 which rotates holding image information as an electrostatic latent image and as a visible image. The paper peeling claw 38 is provided with a paper peeling portion 38*a* for peeling a paper M which has been adhered to the image bearing member 31 and a vibrating portion 38*b* which causes the toner catching sheet 35*e*, which is provided in the cleaning unit, to vibrate accompanying a separating and abutting operation.

The paper peeling claw 38 has two points of action with respect to a single rotating center, the first point of action being the paper peeling portion 38*a* for separating and abutting with respect to the outer circumferential portion of the image bearing member, and the second point of action being the vibrating portion 38*b* for abutting the toner catching sheet 35*e*.

Accordingly, the peeling of the paper M adhered to the image bearing member 31 at the first point of action and the vibration of the toner catching sheet 35*e* at the second point of action are performed by a rotating operation centered around a single rotating center 38*c* of the paper peeling claw 38.

The paper peeling portion 38*a* and the vibrating portion 38*b* which are the points of action of the paper peeling claw 38 are positioned sandwiching the rotating center 38*c* on either side thereof, so when rotating around the rotating center 38*c*, the paper peeling portion 38*a* and the vibrating portion 38*b* move in opposite directions.

Therefore, when the paper peeling portion 38*a* is touching the image bearing member 31 (see FIG. 7(A)), the vibrating portion 38*b* positions the toner catching sheet 35*e* on the side of the cleaning unit 35, and when the paper peeling portion 38*a* is separated from the image bearing member 31 (see FIG. 7(B)), it positions the toner catching sheet 35*e* on the side of the image bearing member 31.

The paper peeling claw 38 has friction charge characteristics of the same polarity as the charge characteristics of the residual toner. Therefore, the residual toner does not attach to the paper peeling claw 38, and the paper M can be prevented from being soiled by the residual toner via the paper peeling claw 38.

Figure 8:
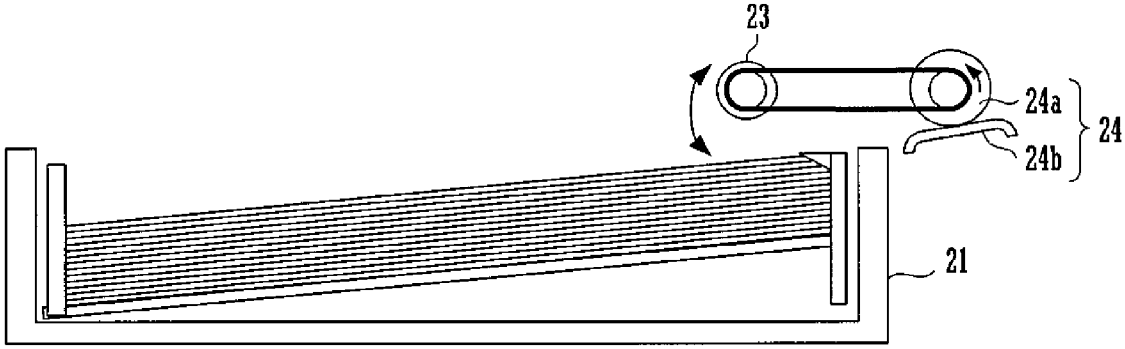
FIG. 8 is a lateral cross-sectional view and a planar view showing the exterior of a paper separating member in a paper feeding portion of the apparatus.
Figure 8:
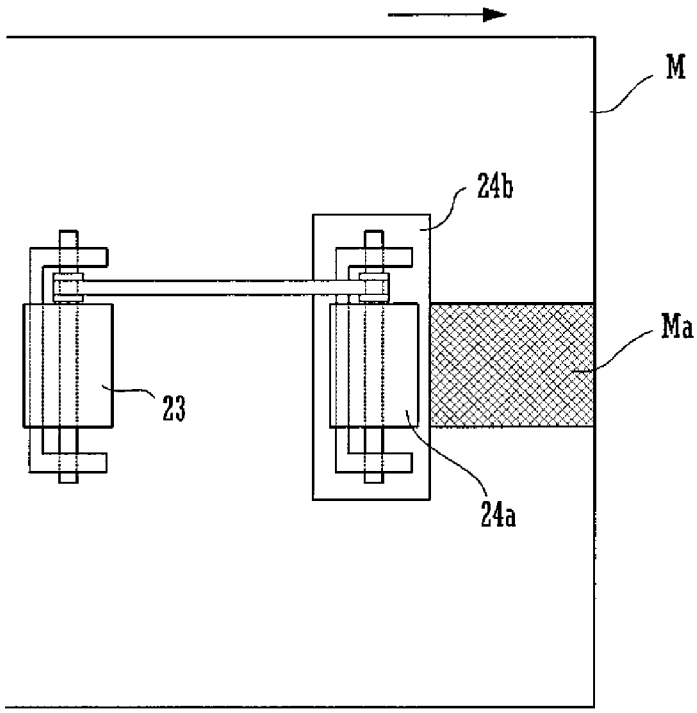

FIG. 8(A) and FIG. 8(B) are a lateral cross-sectional view and a planar view showing the exterior of the paper separating member in a paper feeding portion of the image forming apparatus.

Here, the majority of the generation of the paper dust P is caused by friction, etc. between the paper M and the feed roller 24*a* and the plate member 24*b* when the paper M, which has been transported from the paper feeding tray 21, etc., is separated into a single sheet in the feed roller 24*a* and the plate member 24*b* during image formation. In the embodiment of the present invention, the feed roller 24*a* and the plate member 24*b* touch the paper M in the central section in the sub scanning direction of the paper M, so the paper dust P is generated from a paper dust generating portion Ma, which is the central section in the sub scanning direction of the paper M.

The paper dust P is charged through friction with the transporting rollers and so on, which are not shown in the drawings, during transportation of the paper, and therefore attaches to the outer circumferential portion of the image bearing member 31 during transfer of the toner image to the outer circumferential portion of the image bearing member 31. Accordingly, a large amount of the paper dust P builds up at a paper dust attaching section 31*a* which is the central section in the direction perpendicular to the transporting direction of the paper M on the outer circumferential portion of the image bearing member 31, so that the amount of the paper dust P attached to the outer circumferential portion of the image bearing member 31 is different in the axial direction of the image bearing member 31. In other words, the paper dust P is generated in higher quantities near the center in the axial direction of the image bearing member 31.

Figure 9:
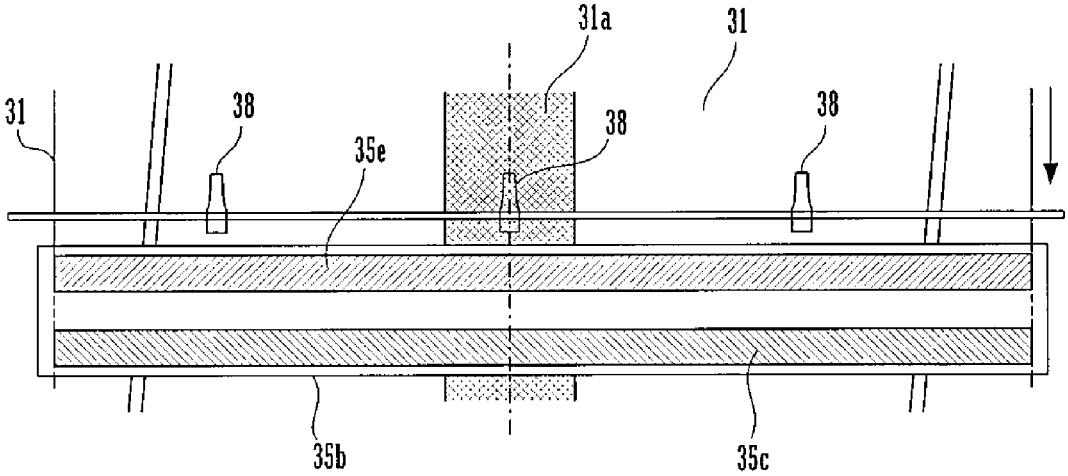
FIG. 9 is an abbreviated view of an outer circumference of an image bearing member.
Figure 10:
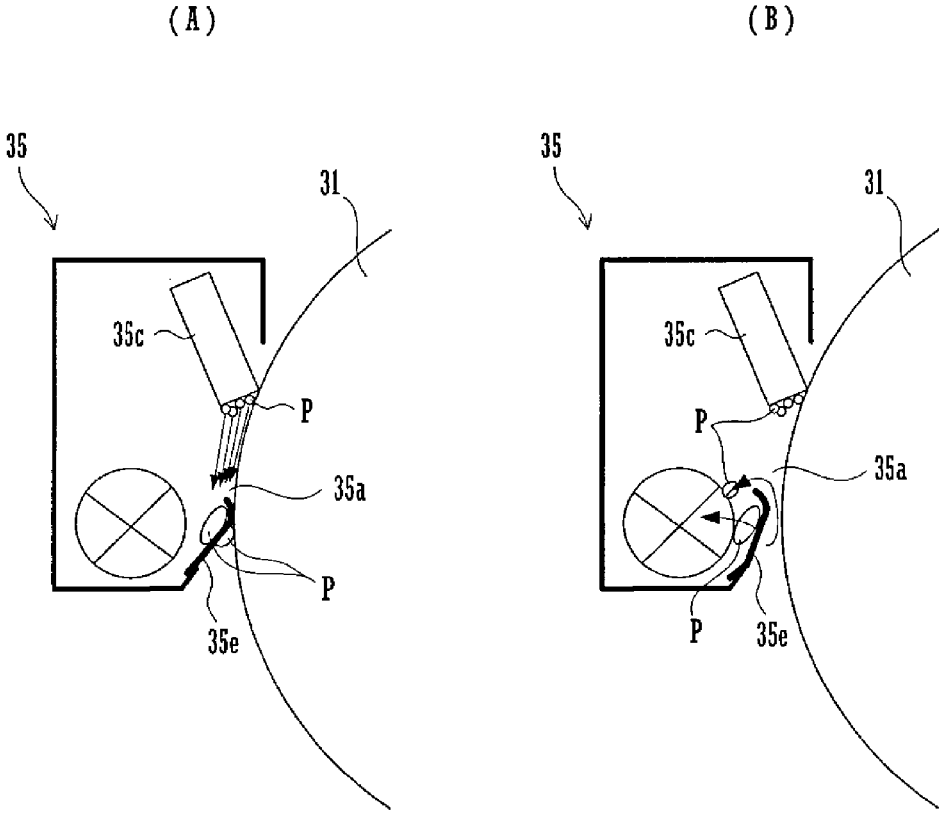
FIG. 10 is a cross-sectional view showing a partial enlargement of the image forming portion provided in the image forming apparatus in which the cleaning device is applied.

Peeling power in order to peel the paper M thoroughly from the image bearing member 31 must be applied at a plurality of positions in the axial direction. Accordingly, as shown in FIG. 9, the paper peeling claw 38 is provided in three locations in the central section in the axial direction of the image bearing member 31 (the direction perpendicular to the paper transporting direction) and sandwiching the central section on either side thereof. On the other hand, paper dust has low fluidity, so, as shown in FIG. 10(A), the paper dust P which is scraped off by the cleaning blade 35*c* easily accumulates on the toner catching sheet 35*e*. Moreover, the toner catching sheet 35*e* touches the outer circumferential portion of the image bearing member 31, so the paper dust P also accumulates at portions of the toner catching sheet 35*e* which touch the outer circumferential portion of the image bearing member 31 and the vicinity thereof. Here, the paper dust P can be collected from the open portion 35*a*, which is located further downstream in the direction of the arrow Y from the location at which is disposed the toner catching sheet 35*e* because wind is generated in the direction of the arrow Y by rotation in the direction of the arrow Y of the image bearing member 31. In other words, as shown in FIG. 10(B), the paper dust P separates from the toner catching sheet 35*e* without clumping via the vibration of the toner catching sheet due to the vibrating portion 38*b* of the paper peeling claw 38, and flows into the open portion 35*a* riding the flow of this wind. Accordingly, the paper dust P can be efficiently collected at sections on the toner catching sheet 35*e* opposing the paper dust P buildup location, where the paper dust P accumulates easily. Moreover, very fine dust can also be eliminated since the toner catching sheet 35*e* moves due to the vibration of the vibrating portion 38*b* as each sheet of the paper M is peeled by the paper peeling claw 38.

The invention claimed is:

1. A cleaning device, comprising:

a cleaning unit which is provided with an open portion disposed opposite an outer circumferential portion of an image bearing member and is disposed downstream of a position for transferring to a paper a toner image which is formed on the image bearing member;

a cleaning blade which is provided in the interior of the cleaning unit and wherein an apical portion abuts the outer circumferential portion of the image bearing member, for scraping off residual toner attached to the image bearing member;

a toner catching sheet disposed upstream in a rotating direction of the image bearing member from the open portion of the cleaning unit body, said toner catching sheet being provided in the interior of the cleaning unit and parallel in a lengthwise direction to an axial direction of the image bearing member; and a paper peeling claw provided upstream on the main body of the cleaning unit body and abuttable to the image bearing member for peeling from the image bearing member the paper onto which has been transferred the toner image when abutting the image bearing member, said paper peeling claw being provided with a paper peeling portion for peeling the paper from the image bearing member and a vibrating portion for causing the toner catching sheet to vibrate by touching the toner catching sheet when the paper peeling portion abuts or separates from the image bearing member.

2. The cleaning device according to claim 1, wherein the paper peeling claw is provided with the paper peeling portion and the vibrating portion with respect to a single rotating center.

3. The cleaning device according to claim 2, wherein the paper peeling claw positions the toner catching sheet on the side of the cleaning unit through the vibrating portion touching the toner catching sheet when the paper peeling portion abuts the image bearing member, and positions the toner catching sheet on the side of the image bearing member through the vibrating portion separating from the toner catching sheet when the paper peeling portion separates from the image bearing member.

4. The cleaning device according to claim 3, wherein the paper peeling portion and the vibrating portion are positioned sandwiching the rotating center on either side thereof.

5. The cleaning device according to claim 1, wherein the paper peeling claw is disposed corresponding to a region in which a separating member is disposed for transporting the paper one sheet at a time to the image bearing member in the axial direction of the image bearing member.

6. The cleaning device according to claim 1, wherein the paper peeling claw has frictional charge characteristics of the same polarity as the charge characteristics of the residual toner.

* * * * *